US007093596B2

(12) United States Patent
Müller et al.

(10) Patent No.: US 7,093,596 B2
(45) Date of Patent: Aug. 22, 2006

(54) CONNECTION COMPONENT FOR A RESPIRATOR PRODUCT

(75) Inventors: Rüdiger Müller, Stockelsdorf (DE); Jürgen Falk, Lübeck (DE); Joachim Schlobohm, Bad Oldesloe (DE)

(73) Assignee: Dräger Safety AG & Co. KGaA, (DE)

( * ) Notice: Subject to any disclaimer, the term of this patent is extended or adjusted under 35 U.S.C. 154(b) by 383 days.

(21) Appl. No.: 10/397,347

(22) Filed: Mar. 26, 2003

(65) Prior Publication Data

US 2003/0217752 A1 Nov. 27, 2003

(30) Foreign Application Priority Data

Mar. 27, 2002 (DE) ..... 102 13 654

(51) Int. Cl.
*A62B 18/08* (2006.01)
*A62B 9/04* (2006.01)

(52) U.S. Cl. ..... 128/206.17; 128/202.27

(58) Field of Classification Search ..... 128/201.25, 128/202.27, 205.25, 205.27, 205.28, 205.29, 128/206.12, 206.16, 206.17, 201.13, 206.15; 55/DIG. 33, DIG. 35
See application file for complete search history.

(56) References Cited

U.S. PATENT DOCUMENTS 4,414,973 A * 11/1983 Matheson et al. ..... 128/206.15
4,453,544 A * 6/1984 Silverthorn ..... 128/206.17
5,154,168 A * 10/1992 Schlobohm ..... 128/205.27
5,579,761 A * 12/1996 Yuschak et al. ..... 128/206.17
5,924,420 A * 7/1999 Reischel et al. ..... 128/206.21
5,996,580 A * 12/1999 Swann ..... 128/206.17
6,016,804 A * 1/2000 Gleason et al. ..... 128/206.17
6,761,169 B1 * 7/2004 Eswarappa ..... 128/205.27
6,860,267 B1 * 3/2005 Capon et al. ..... 128/206.15
2003/0047183 A1 * 3/2003 Kiefer et al. ..... 128/201.15

FOREIGN PATENT DOCUMENTS

WO WO 99/21618 5/1999

* cited by examiner

*Primary Examiner*—Teena Mitchell
(74) *Attorney, Agent, or Firm*—McGlew & Tuttle PC

(57) ABSTRACT

A connection component for a detachable component on a respirator product is provided with which the component can be connected to the respirator product in a simple manner. A bayonet connection (6, 7) is provided between the component and the respirator product. The bayonet connection can be connected in a preferred position and has a first connection part (9) with projecting tongues and a second connection part (10) with recesses designed corresponding thereto. A centering ring (14) is provided on the first connection part (9). The centering ring is arranged around the tongues. A cylindrically designed circumferential surface (11) is provided on the second connection part (10). The circumferential surface is designed as a surface that can be introduced into a groove (13) at the centering ring (14).

20 Claims, 4 Drawing Sheets

CONNECTION COMPONENT FOR A RESPIRATOR PRODUCT

FIELD OF THE INVENTION

The present invention pertains to a connection component for a detachable component on a respirator product.

BACKGROUND OF THE INVENTION

A respirator product in the form of a breathing mask with a connection component between a filter and the mask body of the breathing mask has become known from WO 99/21618. The connection component comprises a bayonet connection with a first connection part with projecting tongues on the mask body and a second connection part on the rear side of the filter, which has correspondingly designed mounting openings for the tongues of the first connection part. The connection parts can be brought together and locked against one another in a certain preferred position only, with the two connection parts snapping into one another. Due to the preferred position to be taken into account during the assembly, the filter always assumes a predetermined position in relation to the mask body in the locked position. It is possible as a result to also arrange the second connection part eccentrically on the filter housing in order to remove the filter cartridge as far away from the field of view of the mask user as possible.

The drawback of the prior-art breathing mask is that the mounting of the filters is made difficult by the fact that a certain preferred position is to be taken into account, especially when the filter must be replaced quickly during use. It may happen now that the connection parts are shifted in relation to one another and the preferred position is thus not found. Even though the mask user can recognize the position of the recesses on the filter connection through the eye-protecting lenses, the corresponding positions of the projecting tongues of the connections on the mask body cannot be recognized because of the limited field of view.

SUMMARY OF THE INVENTION

The basic object of the present invention is to improve a connection component of the type described such that the connection of the components to the respirator product is simplified.

According to the invention, a connection component for a detachable component on a respirator product is provided with a bayonet connection that can be connected in a preferred position between the component and the respirator product. The bayonet connection has a first connection part with projecting tongues and a second connection part with recesses designed correspondingly thereto, a centering ring, which is arranged around the tongues and with a cylindrically designed circumferential surface on the second connection part, which circumferential surface is designed as a surface that can be introduced into the centering ring.

The advantage of the present invention is essentially that finding of the preferred position of the bayonet connection is markedly simplified by a centering ring arranged around the projecting tongues of the first connection part and due to the outer contour of the second connection part being designed with such a cylindrical surface that can be introduced into the centering ring. Due to the cooperation of the circumferential surface with the centering ring, the connection parts of the bayonet connection are fixed in relation to each other, so that they are thus positioned and can be plugged into one another by rotation. The circumferential surface may be in contact with both the inner side and the outer side of the centering ring, the centering ring extending around the circumferential surface in a preferred embodiment.

A groove extending in a ring-shaped manner, into which the circumferential surface of the second connection part can be introduced, is advantageously provided between the centering ring and the tongues.

The bayonet connection is advantageously sealed in the connection area between the circumferential surface and the centering ring by introducing a sealing means there. It is especially advantageous to use an O-ring as the sealing means, which is inserted into a groove located at the circumferential surface.

It is especially advantageous to design the centering ring in terms of its height such that the tongues of the first connection part will be located under the top edge of the centering ring. When the connection parts are brought together, the circumferential surface is at first in contact with the centering ring before the tongues can be meshed with the corresponding recesses. An especially good radial centering of the connection parts in relation to one another is obtained as a result.

The connection component described in the present invention is especially suitable for connecting a respirator filter to a breathing mask. The preferred position of the connection component designed as a bayonet connection is brought about by means of different widths of the projecting tongues, so that the bayonet connection can be locked only when tongues and corresponding recesses of the connection parts are located one on top of another.

If more than one respirator filter is fastened to the breathing mask, the bayonet connections are designed such that the direction of rotation is the same on both sides of the breathing mask. If the bayonet connection is fastened eccentrically on the respirator filter, an advantageous direction of rotation is to pivot the respirator filter from top to bottom after the insertion for locking.

An exemplary embodiment is shown in the figures and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
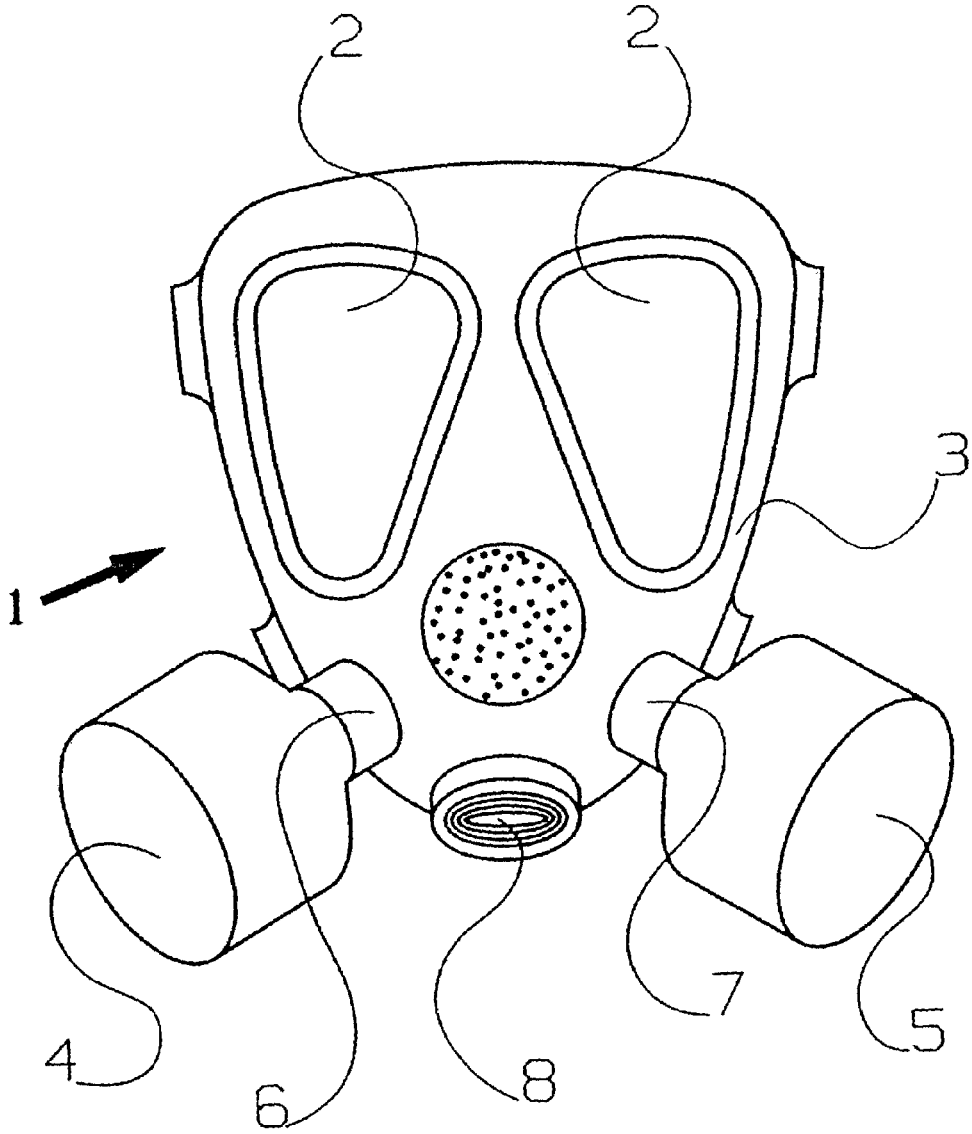
FIG. 1 is a breathing mask with two respirator filters.

Referring to the drawings in particular, FIG. 1 shows a breathing mask 1 with two eye-protecting lenses 2 in a mask body 3 and two respirator filters 4, 5, which are connected to the mask body 3 via bayonet connections 6, 7. An expiration valve 8 is located between the bayonet connections 6, 7.

Figure 2:
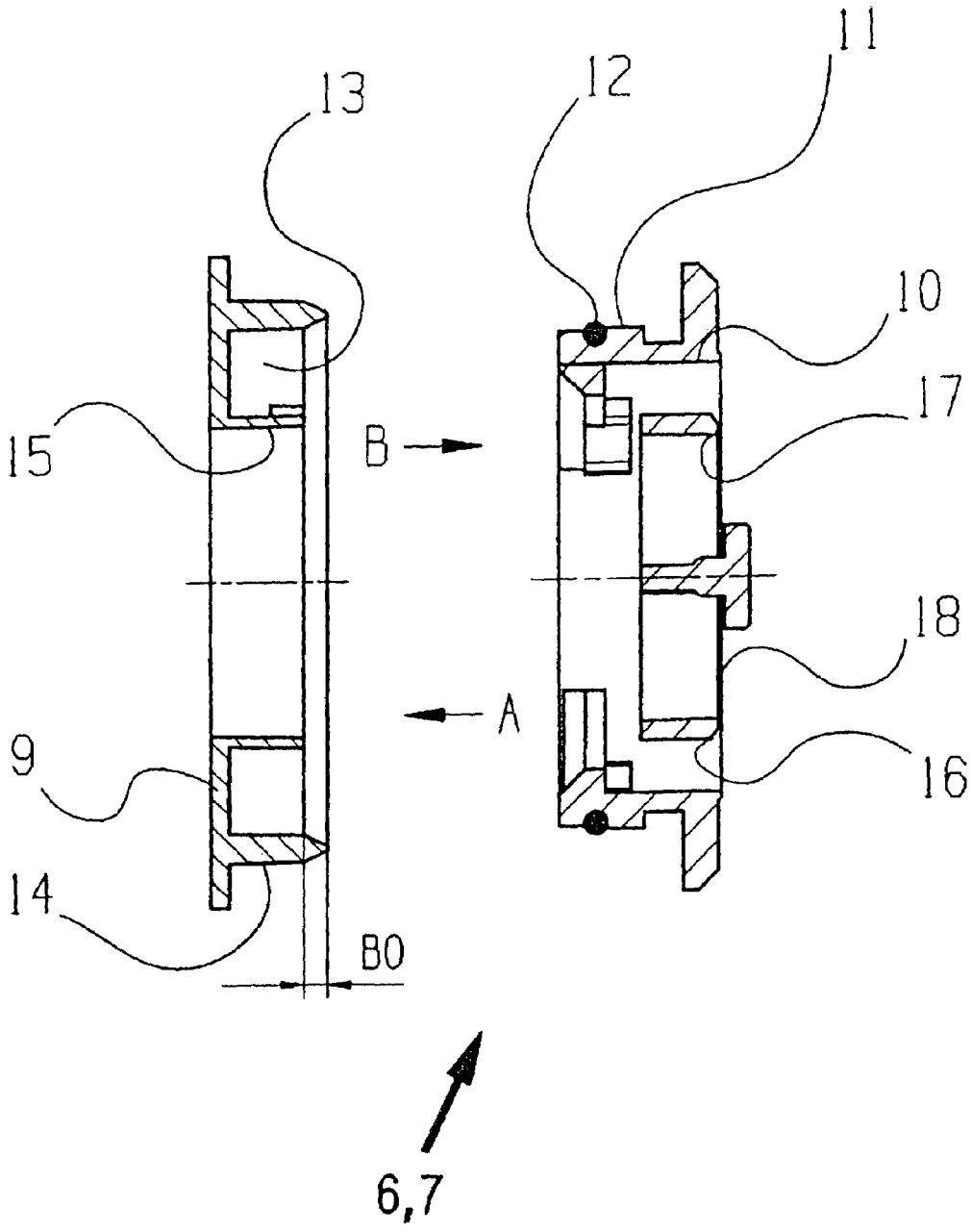
FIG. 2 is a sectional view of the bayonet connection.

FIG. 2 shows the longitudinal section of the bayonet connections 6, 7. They comprise a first connection part 9 at the respirator filter 4, 5 and a second connection part 10 at the mask body 3, FIG. 1. The second connection part 10 has a circumferential surface 11 with an O-ring 12. This connection part 10 can be introduced into a correspondingly designed groove 13 on the first connection part 9. The groove 13 is limited to the outside by a centering ring 14. The height of the centering ring 14 is selected to be such that the top edge of the centering ring 14 projects by a distance B0 in relation to a middle part 15 of the first connection part 9. Gas-tight connection of the connection parts 9, 10 against one another is established by means of the O-ring 12.

The second connection part 10 contains a nonreturn valve 16, comprising a valve crater (or valve seat) 17 and a membrane 18, which lies on the valve crater 17, so that only a gas flow in the direction from the first connection part 9 to the second connection part 10 is possible and a mask user can thus breath in via the respirator filters 4, 5, FIG. 1, but cannot breath out.

Figure 3:
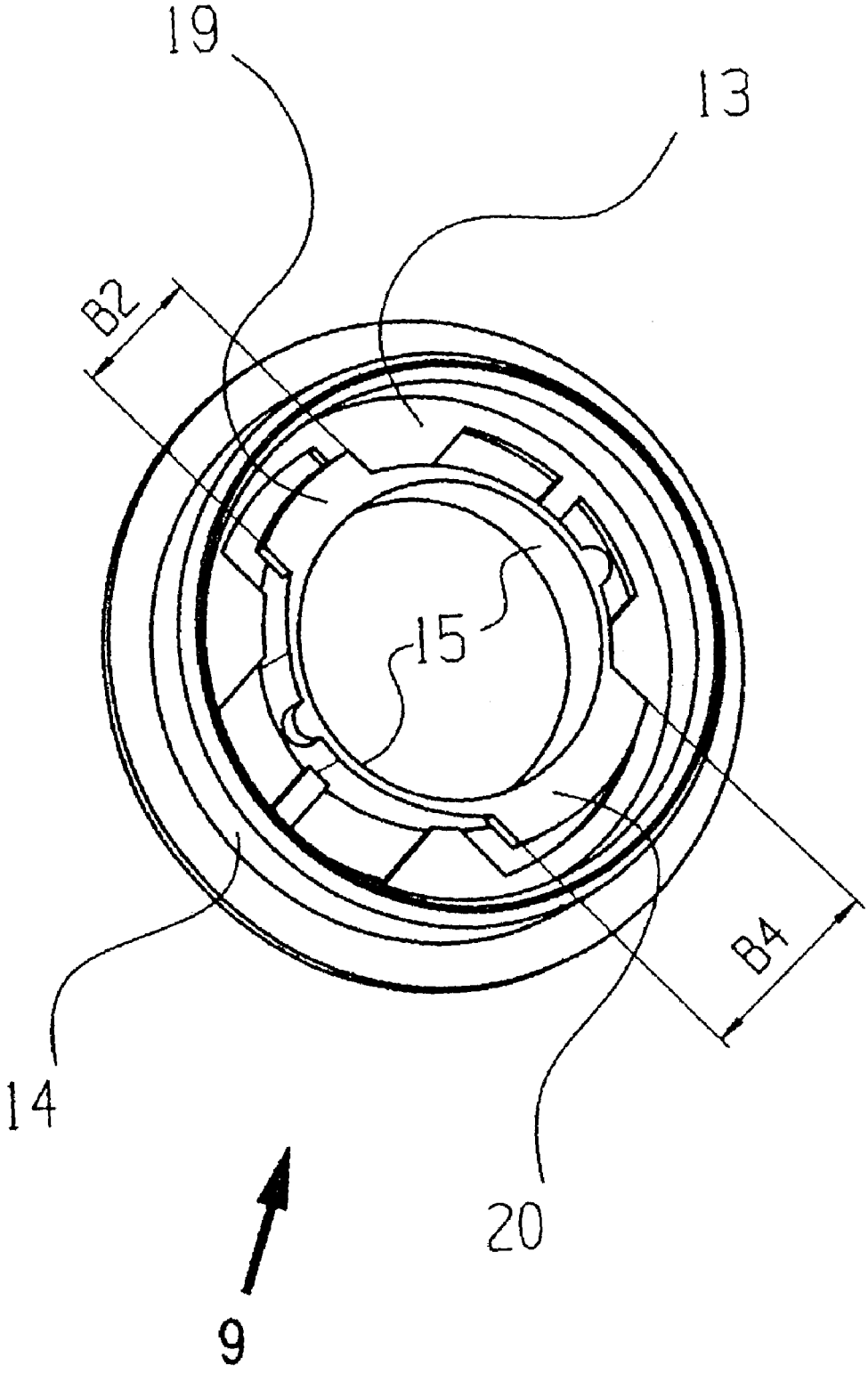
FIG. 3 is a perspective top view of a first connection part of the bayonet connection.

FIG. 3 shows a perspective top view of the first connection part 9 in the direction of view "A" according to FIG. 2. Identical components are designated by the same reference numbers as in FIG. 2.

Two tongues 19, 20, which are arranged opposite each other and have different tongue widths B2, B4, are located at the top end of the middle part 15. The tongue 19 with the width B2 is narrower than the tongue 20 with the width B4.

Figure 4:
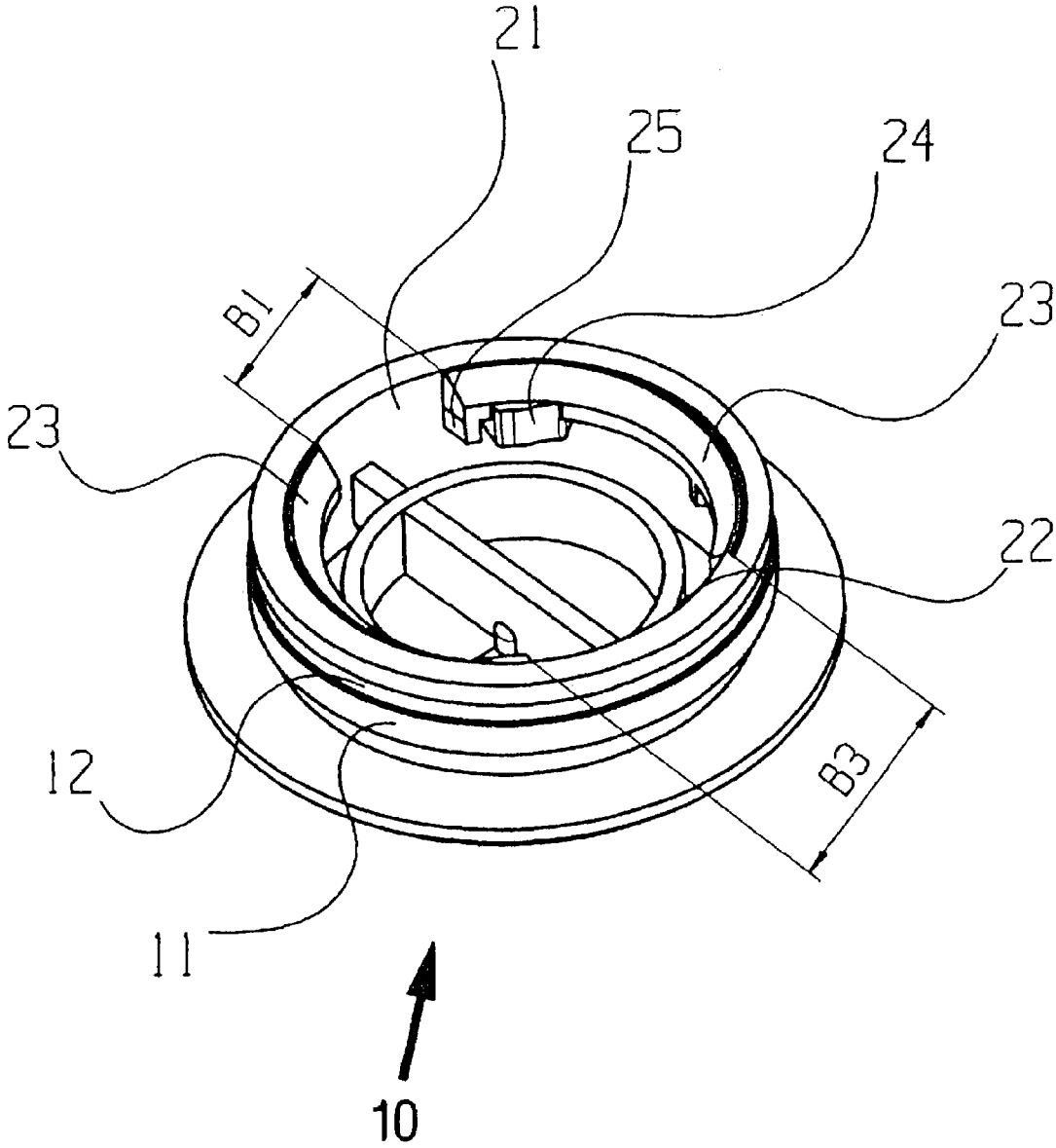
FIG. 4 is a perspective top view of a second connection part of the bayonet connection.

FIG. 4 shows a perspective top view of the second connection part 10 in the direction of view "B" according to FIG. 2. Identical components are designated by the same reference numbers as in FIG. 2. The second connection part 10 has on its inner side two oppositely arranged recesses 21, 22 with the respective widths B1 and B3. The recess 21 with the width B1 corresponds to the tongue 19 in FIG. 3, and the recess 22 with the width B3 is coordinated with the tongue 20 with the tongue width B4. Due to the presence of tongues 19, 20 with different widths and of recesses 21, 22 of a corresponding design that corresponding to them, the connection parts 9, 10 can be mounted in a certain preferred position only, namely, when the tongue 19 is located in the recess 21 and the tongue 20 is located in the recess 22. By rotating the connection parts 9, 10 in relation to one another, the tongues 19, 20, FIG. 3, come to lie under a projection 23, which is located at the top side of the second connection part 10 and which holds the tongues 19, 20 in the second connection part 10, the maximum angle of rotation being limited by a first stop 24. The second connection part 9, FIG. 3, shall be prevented with a second stop 25 from being rotated in the incorrect direction. The second stop 25 also facilitates the finding of the correct direction of rotation.

The bayonet connections 6, 7 described in the present invention are assembled as follows:

The front end of the circumferential surface 11, FIG. 2, is at first in contact with the inner side of the centering ring 14 and is guided by the projecting part of the centering ring 14 with the width B0 in the radial direction. Due to the radial guiding by means of the centering ring 14, the connection parts 9, 10 are rotated against one another until the tongue 19, FIG. 3, is flush above the corresponding recess 21, FIG. 4, so that the connection parts 9, 10 can then be plugged into one another and locked against one another by rotation up to the stop 24.

While a specific embodiment of the invention has been shown and described in detail to illustrate the application of the principles of the invention, it will be understood that the invention may be embodied otherwise without departing from such principles.

What is claimed is:

1. A detachable component respirator product connection component comprising:

a bayonet connection provided in a preferred position between the detachable component and the respirator product, said bayonet connection having a first connection part with projecting tongues and having a second connection part with recesses shaped to receive a shape corresponding to said projecting tongues, said first connection part having a centering ring extending in the same axial direction as said first connection part and arranged around said tongues and said second connection part having a cylindrically designed circumferential surface of a size to be introduced into said centering ring.

2. A connection component in accordance with claim 1, wherein said first connection part has a ring-shaped groove into which a circumferential surface of said second connection part can be introduced, said ring-shaped groove being provided between said centering ring and said tongues.

3. A connection component in accordance with claim 1, further comprising a seal in a connection area between the circumferential surface and the centering ring.

4. A connection component in accordance with claim 1, wherein the centering ring is designed as a centering ring projecting beyond the tongues in said same axial direction as said first connection part.

5. A connection component in accordance with claim 1, wherein the detachable component is a respirator filter.

6. A connection component in accordance with claim 1, wherein the respirator product is a breathing mask.

7. A connection component in accordance with claim 1, wherein a preferred position is established by different widths of the tongues with corresponding different widths of said corresponding recesses.

8. A combination detachable component and respirator product, the combination comprising:

a respirator product;

a detachable component for use in a connected state with said respirator product;

a bayonet connection provided in a preferred position between said detachable component and said respirator product, said bayonet connection having a first connection part with axially extending portion having radially projecting tongues and having a second connection part with axially extending portion defining radially extending recesses corresponding to said projecting tongues, said first connection part having an axially extending centering ring extending in a common axial connection area with said first connection part axially extending portion and arranged around said tongues and said second connection part having an axially extending cylindrically designed circumferential surface of a size to be introduced into said centering ring, said circumferential surface extending in said common axial connection area with said first connection part axially extending portion in a connected state.

9. A combination in accordance with claim 8, wherein said first connection part has a ring-shaped groove into which said circuniferential surface of said second connection part can be introduced, said ring-shaped groove being provided between said centering ring and said tongues.

10. A connection component in accordance with claim 8, further comprising a seal in said connection area between the circumferential surface and the centering ring.

11. A combination in accordance with claim 8, wherein the centering ring is designed as a centering ring projecting over the tongues.

12. A combination in accordance with claim 8, wherein said detachable component is a respirator filter.

13. A combination in accordance with claim 8, wherein said respirator product is a breathing mask.

14. A combination in accordance with claim 8, wherein a preferred position of said detachable component relative to said respirator product is established by different widths of the tongues with corresponding different widths of said corresponding recesses.

15. A combination detachable component and respirator product, the combination comprising:

a respirator product;

a detachable component for use in a connected state with said respirator product;

a first bayonet connection part connected to one of said respirator product and said detachable component, said first bayonet connection part being provided in a preferred position between said detachable component and said respirator product, said first bayonet connection part having a middle part with an annular wall extending axially outwardly and defining a fluid flow passage, said middle part having radially extending tongues and a centering ring with a ring wall extending axially outwardly and arranged radially outwardly of said tongues, said ring wall having a radially facing surface;

a second bayonet connection part connected to the other of said respirator product and said detachable component, said second bayonet connection part comprising a cylinder wall having a circumferential surface extending axially outwardly and of a size to be introduced into said centering ring and having structure radially inwardly of said cylinder defining radially extending recesses of a radial direction shape corresponding to a radial direction shape of said extending tongues, said circumferential surface being disposed inside said centering ring in a common axial connection region and facing said ring wall radially facing surface upon connection of said first bayonet connection part to said second bayonet connection part.

16. A combination in accordance with claim 15, wherein a ring-shaped groove is defined between said centering ring and said tongues, said circumferential surface extending into said ring-shaped groove with said first bayonet connection part connected to said second bayonet connection part.

17. A connection component in accordance with claim 16, further comprising a seal in a connection area between said circumferential surface and said centering ring.

18. A combination in accordance with claim 17, wherein said centering ring is extends axially beyond an axial extent of said tongues.

19. A combination in accordance with claim 18, wherein said detachable component is a respirator filter and said respirator product is a breathing mask.

20. A combination in accordance with claim 15, wherein one of said tongues has different dimensions from another of said tongues and one of said recesses has different dimensions than another of said recesses, such that one of said tongues can only fit into a corresponding one of said recesses, whereby a preferred position of said detachable component relative to said respirator product is established upon connection of said first bayonet connection part to said second bayonet connection part.

* * * * *